US011159863B2

(12) United States Patent
Li

(10) Patent No.: US 11,159,863 B2
(45) Date of Patent: Oct. 26, 2021

(54) LOUDSPEAKER MODULE AND ELECTRONIC DEVICE

(71) Applicant: GOERTEK TECHNOLOGY CO., LTD., Shandong (CN)

(72) Inventor: Zhaopeng Li, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 16/957,773

(22) PCT Filed: Oct. 15, 2018

(86) PCT No.: PCT/CN2018/110213
§ 371 (c)(1),
(2) Date: Jun. 25, 2020

(87) PCT Pub. No.: WO2019/128389
PCT Pub. Date: Jul. 4, 2019

(65) Prior Publication Data

US 2021/0067852 A1 Mar. 4, 2021

(30) Foreign Application Priority Data

Dec. 25, 2017 (CN) ..... 201721846473.9

(51) Int. Cl.
*H04R 1/02* (2006.01)
*H04R 1/28* (2006.01)
(Continued)

(52) U.S. Cl.
CPC ..... *H04R 1/02* (2013.01); *H04R 1/025* (2013.01); *H04R 1/28* (2013.01); *H04R 9/06* (2013.01); *H04R 31/00* (2013.01); *H04R 9/022* (2013.01)

(58) Field of Classification Search
CPC . H04R 1/02; H04R 1/28; H04R 1/025; H04R 9/06; H04R 9/022; H04R 31/00
See application file for complete search history.

(56) References Cited

U.S. PATENT DOCUMENTS 10,149,062 B2 * 12/2018 Zhang ..... H04R 1/06

FOREIGN PATENT DOCUMENTS

CN 203984661 U 12/2014
CN 204046811 U 12/2014
(Continued)

OTHER PUBLICATIONS

International Search Report from International Application No. PCT/CN2018/110213 dated Jan. 16, 2019.

*Primary Examiner* — Andrew L Sniezek
(74) *Attorney, Agent, or Firm* — Brundidge & Stanger, P.C.

(57) ABSTRACT

The present disclosure relates to a loudspeaker module and an electronic device. The loudspeaker module include a loudspeaker unit, a steel sheet and a module housing, wherein the loudspeaker unit is fixed in the module housing and divides an internal space of the module housing into a front chamber and a back chamber; the steel sheet is formed on the module housing by of injection molding; and a hot-melt bonding medium is provided at the position where the steel sheet and the module housing are combined. A technical problem to be solved by the present disclosure is to prevent a gap between a module housing and a steel sheet from occurring during injection molding with the combination strength between the steel sheet and the module housing also being improved, thereby preventing the audio performance of a loudspeaker module from being affected.

8 Claims, 3 Drawing Sheets

(51) Int. Cl.

| | |
|---|---|
| ***H04R 31/00*** | (2006.01) |
| ***H04R 9/06*** | (2006.01) |
| *H04R 9/02* | (2006.01) |

(56) References Cited

FOREIGN PATENT DOCUMENTS

| | | | | | |
|---|---|---|---|---|---|
| CN | 204859547 | U | | 12/2015 | |
| CN | 204993830 | U | | 1/2016 | |
| CN | 106941651 | A | | 7/2017 | |
| CN | 207665190 | U | | 7/2018 | |
| WO | WO-2016155326 | A1 | * | 10/2016 | ..... H04R 9/046 |

* cited by examiner

LOUDSPEAKER MODULE AND ELECTRONIC DEVICE

TECHNICAL FIELD

The present disclosure relates to the technical field of electro-acoustic transducer, in particular, to a loudspeaker module and an electronic device.

BACKGROUND ART

At present, people are pursuing loudspeakers, which are used in electronic products, having high performance with decreased thicknesses. For the purpose of space-saving in a thickness direction and increasing the strength between the housing of the loudspeaker, generally, a part of the plastic material is replaced with steel sheet therein.

However, due to a difference in shrinkage rate of cooling between the steel sheet and the plastic material, the steel sheet and the plastic material are separated during the cooling process of injection molding of forming the housing, and results in a gap, which deteriorate the audio performance of the loudspeaker. At present, the main solution to solve these problems is to adopt a nano injection molding, which is complicated in processing and high cost.

SUMMARY OF THE DISCLOSURE

An object of the present disclosure is to provide a solution which prevents a gap between a module housing and a steel sheet from occurring during injection molding.

According to an aspect, the present disclosure provides a loudspeaker module, including: a loudspeaker unit, a steel sheet and a module housing; wherein the loudspeaker unit is fixed in the module housing and divides an internal space of the module housing into a front chamber and a rear chamber, wherein the steel sheet is provided on the module housing by injection molding, and wherein a hot-melt bonding medium is provided at a position where the steel sheet and the module housing are combined.

Optionally, the module housing has a partition wall between the front chamber and the rear chamber, the steel sheet traverses the front chamber and the rear chamber and is combined with the partition wall by injection molding, the hot-melt bonding medium is provided at a position where the steel sheet and the partition wall are combined.

Optionally, the steel sheet includes a bottom plate and a plurality of first injection molding portions provided at an edge of the bottom plate, the plurality of first injection molding portions extend in a direction toward the module housing, and the hot-melt bonding medium is provided at a combining portion between the bottom plate and the module housing, the plurality of first injection molding portions are coupled in the module housing by injection molding, and the bottom plate is coupled on the module housing by injection molding.

Optionally, a plurality of second injection molding portions are further provided at the edge of the bottom plate, the plurality of second injection molding portions include: a straight section extending toward the module housing, and a flat section extending parallel to the bottom plate from the straight section in a direction away from the bottom plate, the plurality of second injection molding portions are coupled in the module housing by injection molding, or coupled on the module housing by injection molding.

Optionally, the plurality of first injection molding portions and the plurality of second injection molding portions form a zigzag-shaped structure.

Optionally, the steel sheet has a front chamber steel sheet portion corresponding to the front chamber, a ring-shaped hot-melt bonding medium is provided at a position where a periphery of the front chamber steel sheet portion and the module housing are combined.

Optionally, the module housing includes a body portion and a side wall located at an outer edge of the body portion, a sound hole is provided on the side wall, and the hot-melt bonding medium is provided with an opening at a position corresponding to the sound hole.

Optionally, the loudspeaker unit has a rectangular structure, and the hot-melt bonding medium has a rectangular ring structure with an opening.

Optionally, the hot-melt bonding medium is a double-sided hot-melt adhesive.

The present disclosure also provides an electronic device including the loudspeaker module according to any one of the above.

A technical effect of the present disclosure is that, by providing a hot-melt bonding medium between the steel sheet and the module housing, the combination state between the module housing and the steel sheet can be improved by the hot-melt bonding medium, and a gap between the module housing and the steel sheet during injection molding can be prevented from occurring, while improving the combination strength between the steel sheet and the module housing, thereby preventing the audio performance of the loudspeaker module from being affected.

Other features and advantages of the present disclosure will become apparent through the following detailed description of exemplary embodiments of the present disclosure with reference to the drawings.

BRIEF DESCRIPTION OF THE DRAWINGS

The accompanying drawings, which constitute a part of the specification, illustrate embodiments of the present disclosure and serve to explain the principle of the present disclosure together with the description.

DESCRIPTION OF THE EMBODIMENTS

Figure 1:
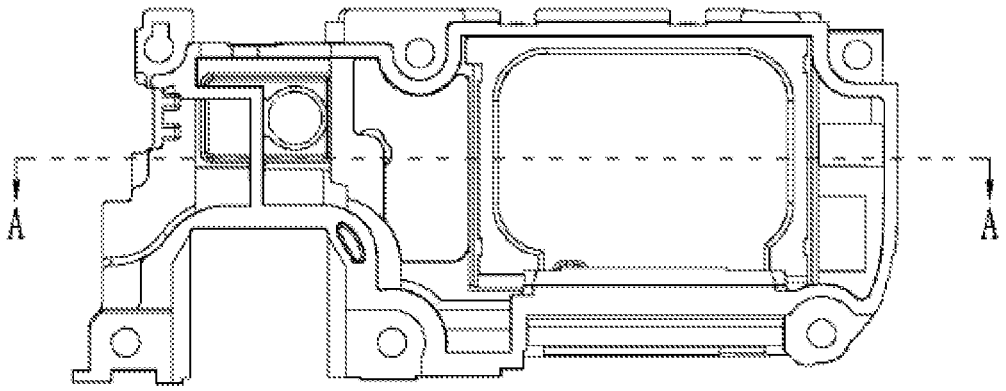
FIG. 1 is a schematic view of a loudspeaker module according to the present disclosure.

Various exemplary embodiments of the present disclosure will be described below in detail with reference to the drawings. It should be noted that: the relative arrangement of components and steps, numerical expressions, and numerical values set forth in these embodiments do not limit the scope of the present disclosure unless otherwise specified.

The following description of at least one exemplary embodiment is indeed only illustrative, and is not intended to limit the present disclosure and its application or use in any way.

The technology and equipment known to those of ordinary skill in the related art may not be discussed in detail, but where appropriate, the technology and equipment should be considered as part of the description.

In all examples shown and discussed herein, any specific values should be interpreted as merely exemplary and not as a limitation. Therefore, other examples of the exemplary embodiments may have different values.

It should be noted that: similar reference numerals and letters indicate similar items in the appended drawings, so once an item is defined in one drawing, it is not necessary to discuss it further in subsequent drawings.

Figure 2:
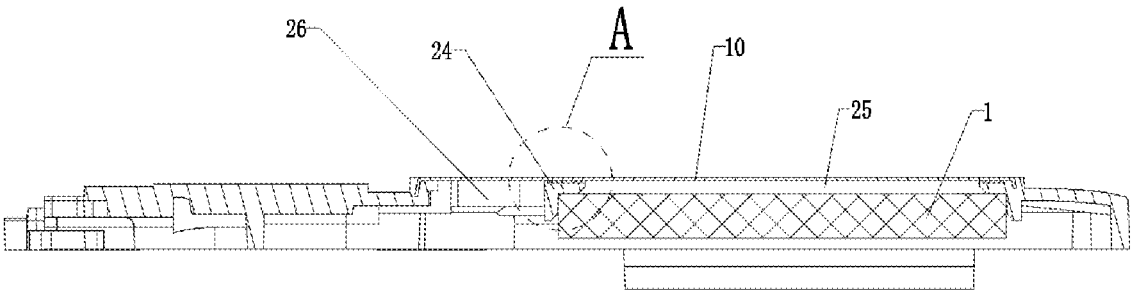
FIG. 2 is a partial cross-section view taken along line A-A in FIG. 1.
Figure 3:
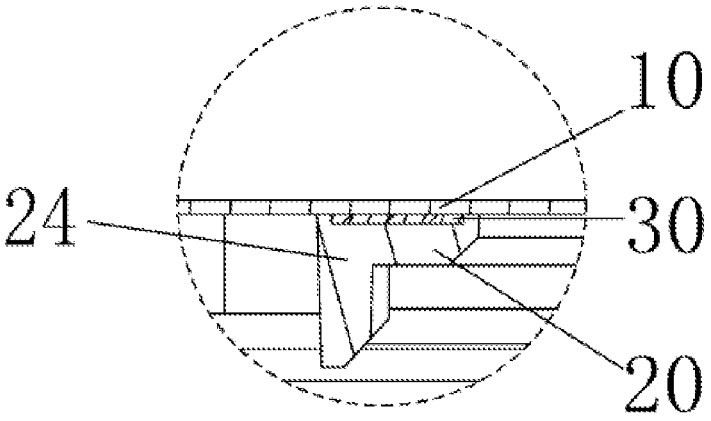
FIG. 3 is an enlarged view of region A in FIG. 2.

Referring to FIG. 1 to FIG. 3, the present disclosure provides a loudspeaker module, including: a loudspeaker unit 1, a steel sheet 10 and a module housing 20.

The loudspeaker unit 1 is fixed in the module housing 20, and divides an internal space of the module housing 20 into a front chamber 25 and a rear chamber 26.

The steel sheet 10 is coupled on the module housing 20 by injection molding.

A hot-melt bonding medium 30 is provided at a position where the steel sheet 10 and the module housing 20 are combined.

A technical effect of the present disclosure is that, by providing a hot-melt bonding medium 30 between the steel sheet 10 and the module housing 20, the combination strength between the module housing 20 and the steel sheet 10 can be improved by the hot-melt bonding medium 30. For example, a difference in shrinkage rate of cooling between the steel sheet 10 and the plastic material can be alleviated, so that a gap between the module housing 20 and the steel sheet 10 during injection molding can be prevented from occurring while improving the combination strength between the steel sheet 10 and the module housing 20, thereby preventing the audio performance of the loudspeaker module from deteriorating. The hot-melt bonding medium 30 includes, but not limited to, a double-sided hot-melt adhesive.

In the present disclosure, the module housing 20 has a partition wall 24 between the front chamber 25 and the rear chamber 26, the steel sheet 10 traverses the front chamber 25 and the rear chamber 26 and is combined with the partition wall 24 by injection molding, the hot-melt bonding medium 30 is provided at a position where the steel sheet 10 and the partition wall 24 are combined.

In the case that the front chamber 25 shares the steel sheet 10 with the rear chamber 26 share, if a gap occurred between the steel sheet 10 and the module housing 20 or between the steel sheet 10 and the partition wall 24, the front chamber 25 and the rear chamber 26 may be communicated with each other or the front chamber 25 and the rear chamber 26 may leak air, deteriorating the audio performance of the loudspeaker module. Thus, in order to prevent air leakage of the front chamber 25 and the rear chamber 26, and the communication between the front chamber 25 and the rear chamber 26, the hot-melt bonding medium 30 is provided at a position where the steel sheet 10 and the partition wall 24 are combined, thereby alleviating the difference in shrinkage rate of cooling between the steel sheet 10 and the partition wall 24 by the hot-melt bonding medium 30, and preventing a gap between the partition wall 24 and the steel sheet 10 from occurring during injection molding.

Figure 4:
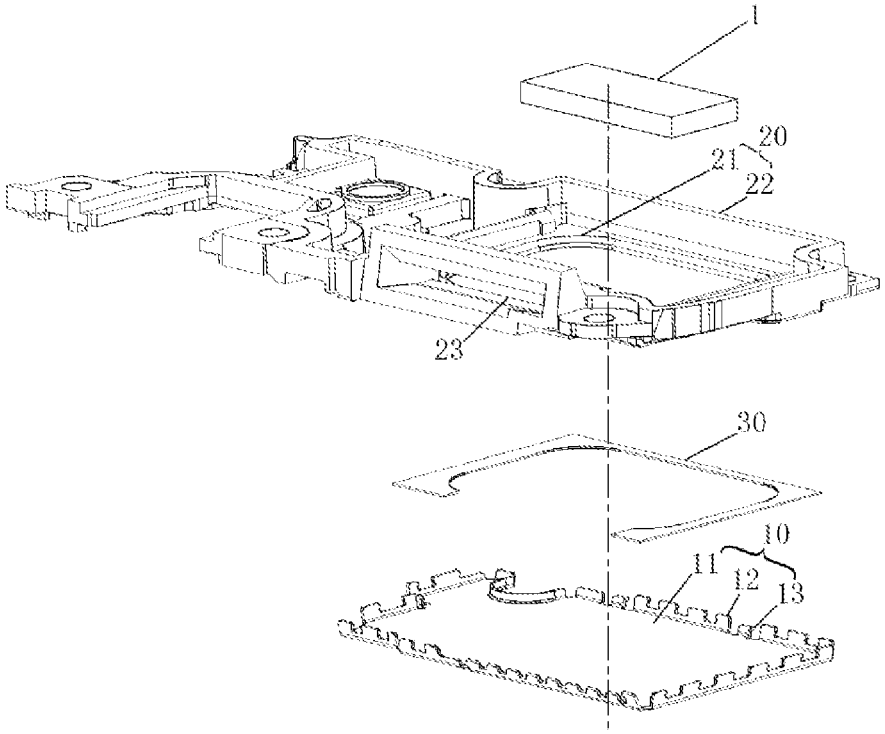
FIG. 4 is an exploded view of the loudspeaker module according to the present disclosure.

Referring to FIG. 4, the steel sheet 10 includes a bottom plate 11 and a plurality of first injection molding portions 12 provided at an edge of the bottom plate 11. The plurality of first injection molding portions 12 extend in a direction toward the module housing 20.

The hot-melt bonding medium 30 is provided at a combining portion between the bottom plate 11 and the module housing 20, the plurality of first injection molding portions 12 are coupled in the module housing 20 by injection molding, and the bottom plate 11 is coupled on the module housing 20 by injection molding. One of the functions of the first injection molding portions 12 is to increase the combination strength between the steel sheet 10 and the module housing 20, which can effectively prevent the steel sheet 10 from separating from the module housing 20.

In the present disclosure, in order to increase the combination strength between the steel sheet 10 and the module housing 20, in addition to the first injection molding portions 12, the bottom plate 11 is further provided with a plurality of second injection molding portions 13 at the edge. The plurality of second injection molding portions 13 include: a straight section extending toward the module housing 20, and a flat section extending parallel to the bottom plate 11 from the straight section in a direction away from the bottom plate 11.

The plurality of second injection molding portions 13 are coupled in the module housing 20 by injection molding, or coupled on the module housing 20 by injection molding. That is, in the case that the plurality of second injection molding portions 13 are coupled in the module housing 20 by injection molding, the second injection molding portions 13 are combined with the module housing 20 via the straight and flat sections, and thus, unlike the first injection molding portions 12, the second injection molding portions 13 can prevent the steel sheet 10 and the module housing 20 from detaching in two directions. In the case that the plurality of second injection molding portions 13 are coupled on the module housing 20 by injection molding, the flat section of the second injection molding portions 13 may have a rounded edgefold structure. The rounded edgefold structure may allow a smooth combining portion between the steel sheet 10 and the module housing 20 after the module housing 20 is cooled, and the steel sheet 10 may not cause damage to the module housing 20.

In a specific implementation example, the plurality of first injection molding portions 12 and the plurality of second injection molding portions 13 form a zigzag-shaped structure.

The mounting manners of the hot-melt bonding medium 30 are different according to different requirements of combination between the steel sheet 10 and the module housing 20. In the present disclosure, the hot-melt bonding medium 30 may be provided at the combining portion between the first and second injection molding portions 12 and 13 and the module housing 20, in addition to the combining portion between the bottom plate 11 and the module housing 20.

Correspondingly, based on different sealing requirements of combining portion between the module housing 20 and the steel sheet 10, the hot-melt bonding medium 30 may only be provided at the sealed combining portion between the steel sheet 10 and the module housing 20. For example, in a specific implementation example, the steel sheet 10 has a front chamber steel sheet portion corresponding to the front chamber 25, and a ring-shaped hot-melt bonding medium 30 is provided at a position where a periphery of the front chamber steel sheet portion and the module housing 20 are combined. At this time, the hot-melt bonding medium 30 can prevent a gap between the steel sheet 10 and a position of the module housing 20 corresponding to the front chamber 25 from occurring.

Refer to FIG. 4 again, the module housing 20 includes a body portion 21 and side walls 22 located at an outer edge of the body portion 21, and the side walls 22 is provided with sound holes 23. The sound holes 23 may allow a sound of the loudspeaker module to be transmitted to outside. The combining portion between the steel sheet 10 and the module housing 20, at a position corresponding to the sound holes 23, may not be sealed. In the present disclosure, in order to apply the hot-melt bonding medium 30 effectively, the hot-melt bonding medium 30 is provided with an opening at a position corresponding to the sound holes 23. The hot-melt bonding medium 30 at the opening is omitted, which saves the cost.

The shape of the hot-melt bonding medium 30 may be provided according to the shape of the loudspeaker unit 1. For example, the loudspeaker unit 1 has a rectangular structure. The hot-melt bonding medium 30 has a rectangular ring structure with an opening. The position of the opening corresponds to that the sound holes 23.

In a specific implementation example, the loudspeaker unit 1 includes a unit front cover and a unit housing, a space enclosed by the unit front cover and the unit housing accommodates a vibrating system and a magnetic circuit system therein. The vibrating system includes a vibrating diaphragm, an edge portion of which is fixed between the unit front cover and the unit housing. A dome is fixed at a side close to the unit front cover of the vibrating diaphragm. A voice coil is fixed at the other side of the vibration diaphragm. The winding tap of the voice coil is a voice coil lead wire, and the voice coil lead wire is electrically connected with an electrical connector through a pad provided on the unit housing and electrically connected with an external circuit of the loudspeaker module through the electrical connector. The magnetic circuit system includes a concentrating flux plate fixed on the unit housing, an inner magnet and an inner washer are fixed in sequence at a center portion of the concentrating flux plate at an inner side thereof, and an outer magnet and an outer washer are fixed in sequence at an edge portion of the concentrating flux plate at the inner side thereof. The inner magnet and the inner washer constitute an inner magnetic circuit, and the outer magnet and the outer washer constitute an outer magnetic circuit, a magnetic gap is provided between the inner magnetic circuit and the outer magnetic circuit, and ends of the voice coil are located in the magnetic gap. The voice coil moves up and down in the magnetic gap according to the magnitude and direction of a sound wave electrical signal in its winding, and the vibrating diaphragm vibrates in accordance with the up-and-down movement of the voice coil, driving the air to make a sound, thereby completing the transducing between electric energy and acoustic energy.

In the present disclosure, the loudspeaker module further includes an electrical connector for electrically connecting the loudspeaker unit 1 and the external circuit.

In a specific implementation example, both ends of the loudspeaker unit 1 near the side portions of the steel sheet 10 are respectively provided with a pad for welding the electrical connector, and the electrical connector includes two first conductive portions for being welded with the pads of the loudspeaker unit 1. The two first conductive portions are connected together through a connecting portion, one of the first conductive portions is connected with a second conductive portion electrically connected to the external circuit of the loudspeaker module, and the second conductive portion is located outside the loudspeaker module.

When the two first conductive portions are welded with the pad on the loudspeaker unit 1, the connecting portion may stretch outside the loudspeaker unit 1. In order to save the internal space of the loudspeaker module, the connecting portion is bent downward and attached on the side walls of the loudspeaker unit 1 via an adhesive backing, so that the connecting portion is prevented from detaching from the side walls of the loudspeaker unit 1, and the side portion of the steel sheet 10 leaves a sufficient space for the connecting portion. The electrical connector is a FPCB (Flexible Printed Circuit Board). Such a structure of the electrical connector effectively saves the internal space of the module, while also ensuring the performance of the loudspeaker module.

In the following, how the module housing 20 and the steel sheet 10 are combined will be described.

Figure 5:
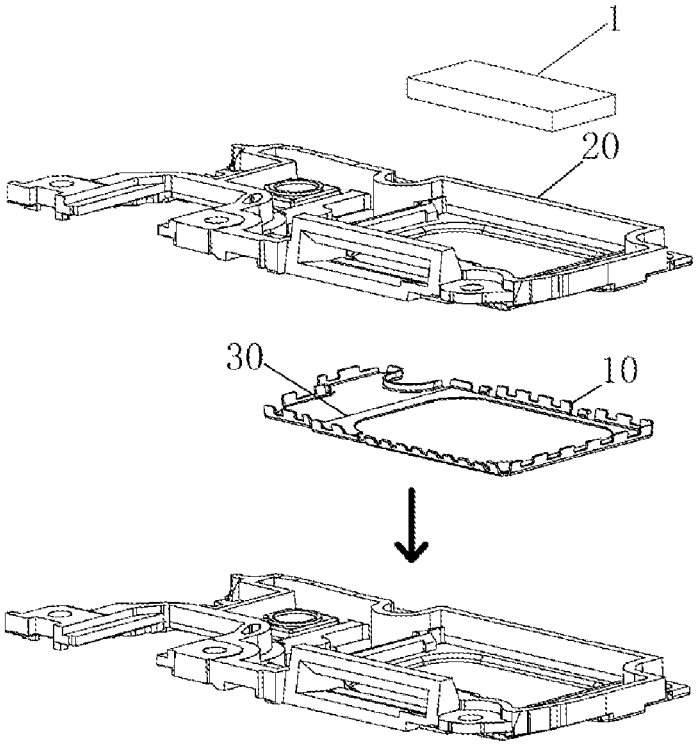
FIG. 5 is a flow chart of combining the steel sheet and the module housing according to the present disclosure.

Referring to FIG. 5, first, the hot-melt bonding medium 30 is bonded to the position where the steel sheet 10 and the module housing 20 are combined. FIG. 5 shows the hot-melt bonding medium 30 is bonded to the bottom plate 11 of the steel sheet 10.

Next, the steel sheet 10 is coupled on the module housing 20 by injection molding, wherein the hot-melt bonding medium 30 is melted by the residual heat of the module housing 20 before it is cooled.

Finally, after it is cooled, the steel sheet 10 and the hot-melt bonding medium 30 are coupled on the module housing 20 by injection molding.

Further, the present disclosure also provides an electronic device, including the loudspeaker module above. The electronic device includes earphones, computers, mobile phones and other electronic devices that can provide a sound function.

Although some specific embodiments of the present disclosure have been described in detail by way of examples, it should be understood by those skilled in the art that, the above examples are only illustrative, and is not intended to limit the scope of the present disclosure. Those skilled in the art should understand that, the above embodiments can be modified without departing from the scope and spirit of the present disclosure. The scope of the present disclosure is defined by the appended claims.

What is claimed is:

1. A loudspeaker module, comprising:

a loudspeaker unit;

a steel sheet; and a module housing, wherein the loudspeaker unit is fixed in the module housing and divides an internal space of the module housing into a front chamber and a rear chamber, wherein the steel sheet is coupled on the module housing by injection molding, wherein a hot-melt bonding medium is provided at a position where the steel sheet and the module housing are combined, and wherein the module housing has a partition wall between the front chamber and the rear chamber, the steel sheet traverses the front chamber and the rear chamber and is injection-molded with the partition wall, and the hot-melt bonding medium is provided at a position where the steel sheet end the partition wall are combined.

2. The loudspeaker module of claim 1, wherein the steel sheet comprises a bottom plate and a plurality of first injection molding portions provided at an edge of the bottom plate, wherein the plurality of first injection molding portions extend in a direction toward the module housing, and wherein the hot-melt bonding medium is provided at a combining portion between the bottom plate and the module housing, the plurality of first injection molding portions are coupled in the module housing by injection molding, and the bottom plate is coupled on the module housing by injection molding.

3. The loudspeaker module of claim 2, wherein a plurality of second injection molding portions are further provided at the edge of the bottom plate, and wherein the plurality of second injection molding portions comprise a straight section extending toward the module housing, and a flat section extending parallel to the bottom plate from the straight section in a direction away from the bottom plate, and wherein the plurality of second injection molding portions are coupled in the module housing by injection molding, or coupled on the module housing by injection molding.

4. The loudspeaker module of claim 3, wherein the plurality of first injection molding portions and the plurality of second injection molding portions form a zigzag-shaped structure.

5. The loudspeaker module of claim 1, wherein the steel sheet has a front chamber steel sheet portion corresponding to the front chamber, and a ring-shaped hot-melt bonding medium is provided at a position where a periphery of the front chamber steel sheet portion and the module housing are combined.

6. The loudspeaker module of claim 1, wherein the module housing comprises a body portion and a side wall located at an outer edge of the body portion, wherein a sound hole is provided on the side wall, and wherein the hot-melt bonding medium is provided with an opening at a position corresponding to the sound hole.

7. The loudspeaker module of claim 6, wherein the loudspeaker unit has a rectangular structure, and wherein the hot-melt bonding medium has a rectangular ring structure with an opening.

8. The loudspeaker module of claim 1, wherein the hot-melt bonding medium is a double-sided hot-melt adhesive.

* * * * *